US010472162B2

(12) United States Patent
Gonzalez et al.

(10) Patent No.: US 10,472,162 B2
(45) Date of Patent: Nov. 12, 2019

(54) CONTINUOUS SPRAY DISPENSER FOR HIGHLY CORROSIVE AND OTHER LOW COMPATIBILITY PRODUCTS

(71) Applicant: THE CLOROX COMPANY, Oakland, CA (US)

(72) Inventors: German R. Gonzalez, Pleasanton, CA (US); Sarah Coulter, Pleasanton, CA (US); Francis Culang, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 15/261,766

(22) Filed: Sep. 9, 2016

(65) Prior Publication Data

US 2018/0072486 A1 Mar. 15, 2018

(51) Int. Cl.

| | |
|---|---|
| ***B65D 83/62*** | (2006.01) |
| ***B65D 83/66*** | (2006.01) |
| *B65D 83/14* | (2006.01) |
| *B65D 83/42* | (2006.01) |

(52) U.S. Cl.

CPC ..... *B65D 83/62* (2013.01); *B65D 83/663* (2013.01); *B65D 83/42* (2013.01); *B65D 83/752* (2013.01)

(58) Field of Classification Search

CPC ..... B65D 83/62; B65D 83/205; B65D 83/24; B65D 83/32; B65D 83/384; B65D 83/48; B65D 83/752

See application file for complete search history.

(56) References Cited

U.S. PATENT DOCUMENTS

| | | | | |
|---|---|---|---|---|
| 3,244,326 | A * | 4/1966 | Bull, Jr. | B67D 1/045 220/720 |
| 3,929,678 | A | 12/1975 | Laughlin et al. | |
| 3,948,225 | A | 4/1976 | Lester | |
| 4,259,217 | A | 3/1981 | Murphy | |
| 4,322,020 | A * | 3/1982 | Stone | B05B 11/004 222/105 |
| 4,565,647 | A | 1/1986 | Llenado | |
| 4,709,734 | A * | 12/1987 | Rudick | B65D 83/44 141/18 |
| 4,796,788 | A * | 1/1989 | Bond | B65D 77/067 222/105 |

(Continued)

FOREIGN PATENT DOCUMENTS

| | | |
|---|---|---|
| EP | 0271044 A2 | 6/1988 |
| EP | 2801465 A2 | 11/2014 |

*Primary Examiner* — David P Angwin
*Assistant Examiner* — Bob Zadeh
(74) *Attorney, Agent, or Firm* — Erin Collins

(57) ABSTRACT

A spray dispensing device including a first chamber defined by a container, a bladder contained within the first chamber that houses a fluid composition (e.g., a bleach composition), and an actuator in fluid communication with the first chamber so as to allow dispensing of the fluid composition from the bladder when the actuator is actuated (e.g., pressed). A pressurized composition may be contained within a second chamber, which acts as a pressure control device. The pressure of the pressurized composition may be in a range of from about 70 psi to about 150 psi. An outlet valve may provide selective fluid communication between the pressure control device (i.e., the second chamber) and the first chamber.

24 Claims, 5 Drawing Sheets

(56) References Cited

U.S. PATENT DOCUMENTS 4,867,344 A * 9/1989 Bitterly ..... A61B 5/026 222/105
5,156,300 A 10/1992 Spahni et al.
5,179,982 A * 1/1993 Berube ..... B65B 31/003 141/113
5,301,838 A 4/1994 Schmidt et al.
5,305,957 A * 4/1994 Szocs ..... B01F 3/04007 169/28
5,407,629 A 4/1995 Schmidt et al.
5,423,454 A * 6/1995 Lippman ..... B65D 83/625 204/271
5,435,452 A 7/1995 Nishigami et al.
5,447,678 A 9/1995 Kneer et al.
5,567,377 A 10/1996 Nishigami et al.
5,567,489 A * 10/1996 Allen ..... A61F 5/445 428/34.1
5,776,872 A 7/1998 Giret et al.
5,865,350 A * 2/1999 Losenno ..... B65D 83/62 222/105
5,883,059 A 3/1999 Furman et al.
5,883,062 A 3/1999 Addison et al.
5,906,973 A 5/1999 Ouzounis et al.
6,109,468 A 8/2000 Kneer
6,244,852 B1 6/2001 Kneer
6,266,943 B1 7/2001 Nomoto et al.
6,276,558 B1 8/2001 Kneer
6,412,659 B1 7/2002 Kneer
6,418,978 B2 7/2002 Bailly
6,670,007 B1 12/2003 Safian et al.
6,742,676 B2 6/2004 Nakamura et al.
6,953,155 B2 * 10/2005 Joseph ..... B05B 7/241 222/105
7,017,761 B1 3/2006 Kneer
7,021,495 B2 4/2006 De Laforcade
7,055,707 B2 6/2006 Yoneyama et al.
7,104,426 B2 9/2006 Suzuki
7,308,991 B2 12/2007 Alberg
7,357,335 B2 4/2008 Laidler
7,482,047 B1 1/2009 Tremley et al.
7,837,927 B2 11/2010 Morel et al.
7,867,434 B2 1/2011 Iwahashi et al.
7,984,831 B2 7/2011 Kanfer et al.
8,038,034 B2 10/2011 Pelfrey
8,240,518 B2 8/2012 Canfield
8,292,121 B2 10/2012 Davideit et al.
8,444,017 B2 5/2013 Chiba et al.
8,579,158 B2 11/2013 Rice
8,794,487 B2 * 8/2014 Maas ..... B29C 49/0073 156/242
8,820,578 B2 9/2014 Kneer et al.
8,955,715 B2 2/2015 Kneer et al.
9,045,268 B2 6/2015 Pelfrey
9,199,785 B2 12/2015 Kneer
9,352,897 B2 5/2016 Hoshino
2001/0002598 A1 6/2001 Van't Hoff
2003/0029888 A1 * 2/2003 McBride ..... B60S 5/02 222/386.5
2005/0230419 A1 10/2005 Safian
2006/0006584 A1 1/2006 Kneer
2006/0233592 A1 10/2006 Knopow
2007/0164039 A1 * 7/2007 Vanblaere ..... B65D 83/62 220/723
2007/0289071 A1 12/2007 Smith et al.
2009/0108021 A1 * 4/2009 Hansen ..... B65D 83/202 222/1
2009/0236363 A1 * 9/2009 Haley ..... B32B 15/08 222/95
2009/0294480 A1 12/2009 Canfield
2010/0044393 A1 2/2010 Moretti
2010/0095529 A1 4/2010 Hawes et al.
2014/0020337 A1 1/2014 Boumnso
2014/0183229 A1 7/2014 Swieten et al.
2018/0072486 A1 * 3/2018 Gonzalez ..... B65D 83/62

* cited by examiner

CONTINUOUS SPRAY DISPENSER FOR HIGHLY CORROSIVE AND OTHER LOW COMPATIBILITY PRODUCTS

BACKGROUND OF THE INVENTION

1. The Field of the Invention

The present invention relates to dispensing devices, particularly to hand-held dispensing containers for spraying cleaning compositions, e.g., such as bleach. Although particularly suitable for dispensing compositions including an oxidant or other corrosive and/or low compatibility component, other fluid compositions could also be dispensed from the device.

2. Description of Related Art

Currently, bleach compositions are typically provided in jugs or similar containers that require the user to pour the desired amount of bleach. Some bleach containing products (e.g., toilet bowl cleaners) are packaged in squeezable containers that allow a user to squirt a desired amount of the product by squeezing the sides of the container. While bleach compositions are highly efficacious at cleaning, and killing microbes (e.g., sanitizing, disinfecting, and sterilizing), there continues to be a need for alternative, more convenient modes of dispensing such compositions. Previous attempts to dispense such compositions through alternative mechanisms have been hampered by the presence of oxidizing agents (e.g., typically hypochlorites and/or peroxides) within the composition, which are highly corrosive and/or otherwise incompatible with many materials.

BRIEF SUMMARY

One aspect of the present invention relates to a spray dispensing device that may dispense a fluid composition. In some embodiments, the fluid composition may be a cleaning or other composition including an oxiziding agent, or other corrosive agent that may corrode or otherwise compromise components typically employed in spray mechanisms, containers, and the like. According to one embodiment, a spray dispensing device may include a first chamber defined by a container having contoured sidewalls (e.g., a non-cylindrical container, e.g., which may include a wide variety of shapes for ornamental purposes, enhanced gripping, or the like). The device may further include a bladder contained within the first chamber, which bladder houses a fluid composition to be dispensed (e.g., an oxidizing bleach composition). An actuator may be provided in fluid communication with the first chamber configured to dispense the fluid composition from the bladder upon actuation of the actuator. A second chamber may also be provided, which acts as a pressure control device. A pressurized composition may be contained in the second chamber, e.g., at a pressure in a range of about 70 psi to about 150 psi. An outlet valve may be provided, which provides selective fluid communication between the pressure control device and the first chamber.

Such an outlet valve may be configured to provide a substantially constant pressure within the first chamber, so as to apply a substantially constant pressure against the bladder over the life of the spray dispensing device (which device may typically be disposable after the contents have been spent). Such a configuration may allow for continuous dispensing of the fluid composition so long as the actuator remains actuated. Where substantially constant pressure is provided within the first chamber, the spray stream or aerosol of dispensed fluid may advantageously be maintained at a substantially constant flow rate and pattern over the life of the spray dispensing device. In other words, the last portion of fluid composition dispensed from the container may be dispensed with similar spray pattern and other characteristics as compared to the first portion of fluid composition dispensed from the container. In addition, the described configuration may also allow the container to be inverted, or rotated to any desired orientation, while still maintaining the same dispensing characteristics (i.e., dispensing is not gravity dependent).

Another spray dispensing device may include a first chamber defined by a container, a bladder contained within the first chamber and housing a fluid composition, and an actuator in fluid communication with the first chamber configured to dispense the fluid composition from the bladder upon actuation thereof. A second chamber (e.g., also disposed within the container) may be provided which acts as a pressure control device, and a pressurized composition may be contained within the second chamber. The pressurized composition may be selected from the group consisting of: air, nitrogen, carbon dioxide, nitrogen, inert components (e.g. argon) and combinations thereof. Any components of the pressurized composition may be in solid, liquid or gaseous phases and any combinations thereof (e.g. liquid nitrogen, carbon dioxide gas, solid carbon dioxide, etc.). An outlet valve may provide selective fluid communication between the pressure control device and the first chamber, e.g., so as to selectively permit the pressurized composition to flow from the second chamber (i.e., the pressure control device) into the first chamber as the fluid composition is dispensed, in order to maintain a substantially constant pressure within the first chamber. The spray dispensing device may be free of hydrocarbon propellants.

The elimination of the use of any hydrocarbon propellants reduces or eliminates the detrimental environmental effects associated with use of such propellants in existing dispensing systems. In addition, in the present system the composition which may contain corrosive or strong oxidizing agents does not require being filled under pressure. Not working with or handling a pressurized corrosive and/or oxidizing composition is a significant advantage during manufacturing because it is much safer to work with and reduces manufacturing complexity. The present system instead provides a "bag-on-valve" or "bag-in-bottle" (used interchangeably herein) type dispensing system combined with a separate second chamber that serves as a pressure control device, so as to provide the non-hydrocarbon pressurized composition into the first chamber as needed. The pressurized composition employed may advantageously be air, nitrogen, carbon dioxide, or other relatively environmentally inert component (e.g. in gaseous or liquid phase), which is able to drive the fluid composition from the bladder upon the user actuating the actuator, as this pressurized composition flows through the outlet valve and into the first chamber.

Another embodiment is directed to a spray dispensing device that does not include an internal piston. The device may include a first chamber defined by a container having non-linear sidewalls (e.g., where the chamber is non-cylindrical), in which the chamber has a transverse cross-section that varies along a vertical axis of the first chamber. The lack of an internal piston allows the chamber to have any desired shape, e.g., which may include contouring or other features for ornamentation, improved grip, or other purposes within the central body portion of the sidewall of the container defining the first chamber. By way of example, the central body portion of the sidewall of the container and the first chamber may be narrowed in its central portion, and wider towards the top and bottom ends. Numerous other contoured shapes are also possible. Such a shape in the interior of the first chamber is possible where the spray dispensing device does not rely on a piston movable within the first chamber to drive dispensing of the fluid composition from the dispensing device.

The device may further include a bladder contained within the first chamber, housing a fluid composition, an actuator in fluid communication with the first chamber, a second chamber which acts as a pressure control device, and a pressurized composition contained within the second chamber. The pressurized composition may comprise: air, nitrogen, carbon dioxide, inert components (e.g. argon) and any combinations thereof. The pressurized composition may be in solid, liquid or gaseous phases and any combinations thereof. Any of the forgoing pressurized composition materials may be in liquid or gaseous phase. An outlet valve may provide selective communication between the second chamber (i.e., the pressure control device) and the first chamber.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
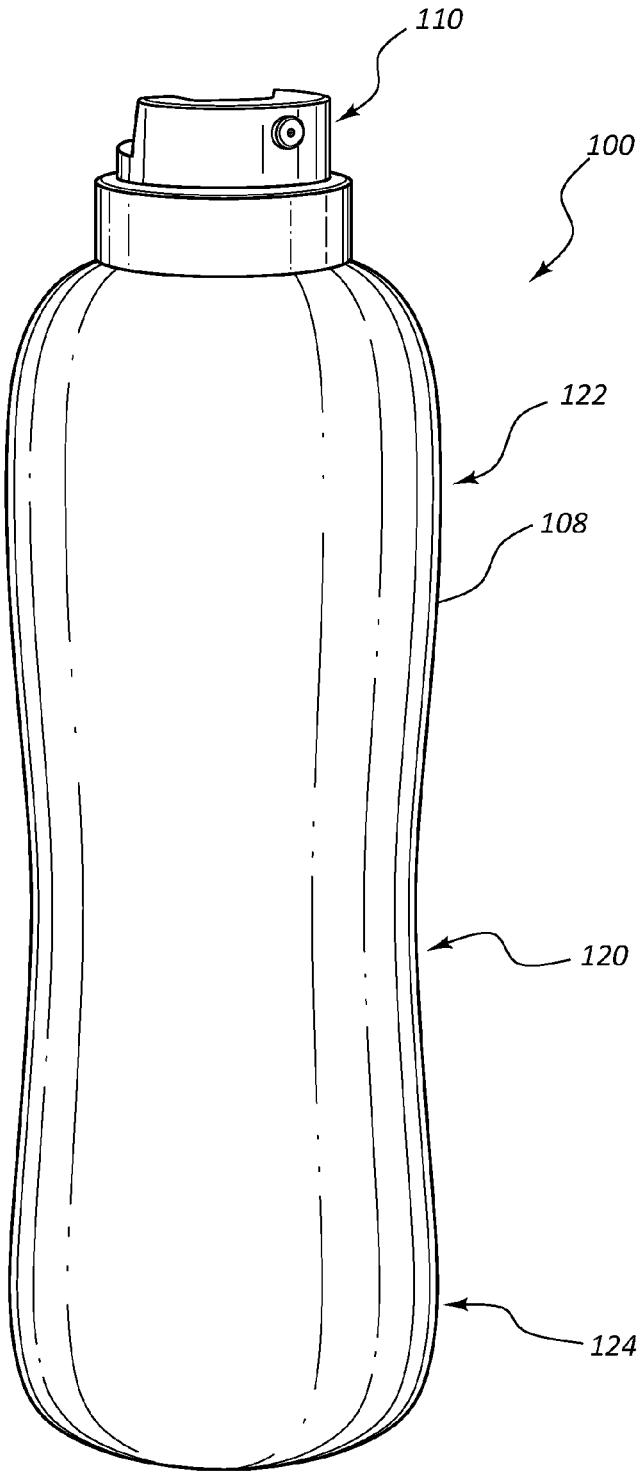
FIG. 1 is a perspective view of an exemplary spray dispensing device.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

The compositions described herein may provide sanitization, disinfection, or sterilization. As used herein, the term "sanitize" shall mean the reduction of contaminants in the inanimate environment to levels considered safe according to public health ordinance, or that reduces the bacterial population by significant numbers where public health requirements have not been established. By way of example, an at least 99% reduction in bacterial population within a 24 hour time period is deemed "significant." Greater levels of reduction are possible, as are faster treatment times (e.g., within 1 minute), when sanitizing. As used herein, the term "disinfect" shall mean the elimination of many or all pathogenic microorganisms on surfaces with the exception of bacterial endospores. As used herein, the term "sterilize" shall mean the complete elimination or destruction of all forms of microbial life and which is authorized under the applicable regulatory laws to make legal claims as a "sterilant" or to have sterilizing properties or qualities. Some embodiments of the present compositions provide for at least a 3 or more log reduction in bacterial population within a designated time period. A 3-log reduction is equivalent to at least a 99.9% reduction, a 4-log reduction is equivalent to at least a 99.99% reduction, a 5-log reduction is equivalent to at least a 99.999% reduction, etc.

Unless otherwise stated, all percentages, ratios, parts, and amounts used and described herein are by weight.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

In the application, effective amounts are generally those amounts listed as the ranges or levels of ingredients in the descriptions, which follow hereto. Unless otherwise stated, amounts listed in percentage ("%'s") are in weight percent (based on 100% active) of the fluid composition.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

In an aspect, the present invention is directed to a spray dispensing device including a first chamber defined by a container (e.g., which may include contoured, non-cylindrical sidewalls), a bladder contained within the first chamber that houses a fluid composition (e.g., a bleach composition), and an actuator in fluid communication with the first chamber (e.g., or more particularly, in fluid communication with the interior of the bladder) so as to allow dispensing of the fluid composition from the bladder when the actuator is actuated (e.g., pressed). A pressurized composition may be contained within a second chamber, which acts as a pressure control device. The pressure of the pressurized composition may be in a range of from about 70 psi to about 150 psi. An outlet valve may provide selective fluid communication between the pressure control device (i.e., the second chamber) and the first chamber.

The present spray dispensing devices advantageously provide the ability to deliver a fluid composition including an oxidizing agent, or other fluid composition which may include a corrosive agent, or other component exhibiting other incompatibility issues, as a continuous spray aerosol. Such aerosol dispensing of bleach and similar compositions has not previously been possible as a practical matter. The claimed spray dispensing devices may provide the fluid composition prepackaged within the spray dispensing device (e.g., within the bladder thereof). The disclosed configuration ensures that the bleach or other fluid composition does not contact the interior of the container of the spray dispensing device, which provides several advantages, making delivery of such a bleach aerosol or similar low compatibility fluid composition possible. In addition to providing a configuration where the fluid composition does not contact the interior of the container, there is no contact between any propellant employed in dispensing the fluid composition and the fluid composition itself. Thus, dispensing of the pure fluid composition itself is possible.

In addition, in one embodiment of the invention no hydrocarbon propellants (e.g., isopentane, propane, isobutane, pentane, butane, fluorinated hydrocarbons, and the like) are needed. For example, the employed pressurized component (rather than a conventional propellant), as stored in the second chamber, may comprise: air, nitrogen, carbon dioxide, nitrogen, inert components (e.g. argon) and any combinations thereof. The pressurized composition may be in solid, liquid or gaseous phases and any combinations thereof. As the pressurized component does not contact the fluid composition itself (rather only the bladder), there is no risk of reactions, contamination, degradation, or the like that may otherwise occur with traditional aerosol systems in which a propellant and fluid composition being dispensed are mixed with or one another or otherwise contact one another.

The disclosed dispensing devices also advantageously allow dispensing the fluid composition even when the container is in an inverted position, or any position in between inverted and a normal upright orientation. Where dispensing does not rely on the inclusion of any internal piston, the sidewalls of the container may be other than cylindrical. For example, various contours are possible for ornamentation, for enhanced grip, or for other purposes. Such configurations also allow the second chamber which acts as the pressure control device to be oriented as desired, and not necessarily in axial alignment with the longitudinal axis of the device, or with the bladder. In other words, in previous configurations, there has always been axial alignment with the various components in the spray dispensing system (i.e., all aligned with the longitudinal axis). In another embodiment of the invention, the pressure control device could be provided outside of or separate from the dispensing device and could be attached/coupled to the device immediately prior to use. Alternatively, the pressure control device may be coupled to the dispensing device and still be outside or separate from the dispensing device. Alternatively, the pressure control device maybe inside the spray dispensing system, but not attached to the interior of the dispensing device such that it may be created and/or filled externally prior to being placed in the dispensing device. In this embodiment, the pressure control device may have an outlet valve attached to it so that is fully functionally prior to being placed into the dispensing device. When the pressure control device has an outlet valve attached to the pressure control device, the container may be created without an outlet valve attached to any of the container walls. The present configurations allow for the alignment and non-separable arrangement requirements to be eliminated, freeing the configuration from such necessary alignment and detachment/separation problems between the dispensing container, the outlet valve and the pressure control device III. Exemplary Dispensing Systems FIGS. 1-4 show an exemplary spray dispensing device 100 which may be prefilled (e.g., during manufacture) with any desired fluid composition. In some embodiments, the fluid composition may include an oxidizing agent (e.g., one or more of hypochlorites, halogens, peroxides, hypochlorous acid, or the like). Examples of hypochlorites include, but are not limited to alkali metal hypochlorites (e.g., sodium hypochlorite, potassium hypochlorite, and the like, alkali earth metal hypochlorites (e.g., calcium hypochlorite, magnesium hypochlorite, and the like). Combinations of hypochlorites may of course be employed. An example of a peroxide is hydrogen peroxide, although other peroxides may also be employed.

Figure 2:
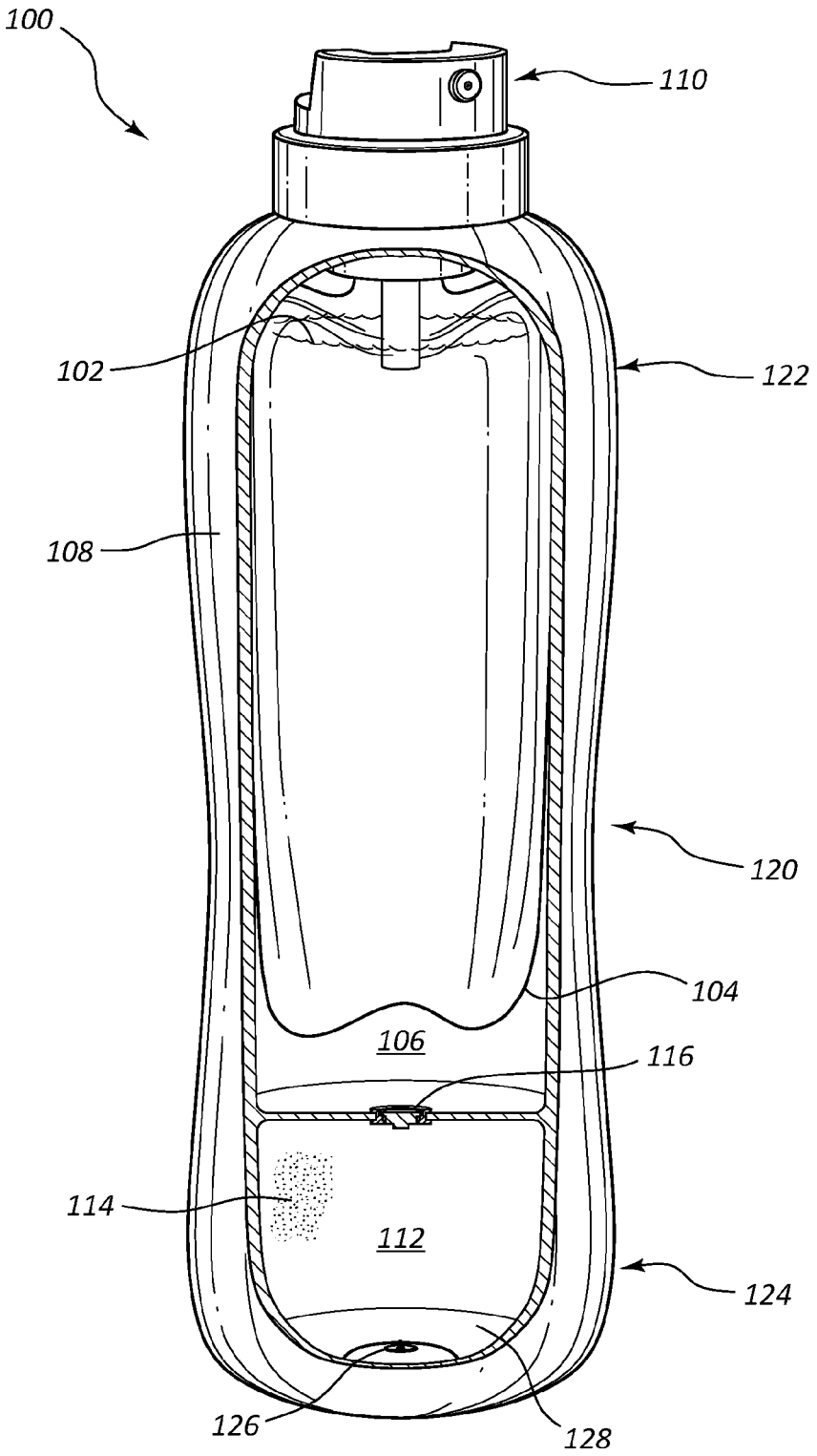
FIG. 2 is a cut-away view of the spray dispensing device of FIG. 1.
Figure 3:
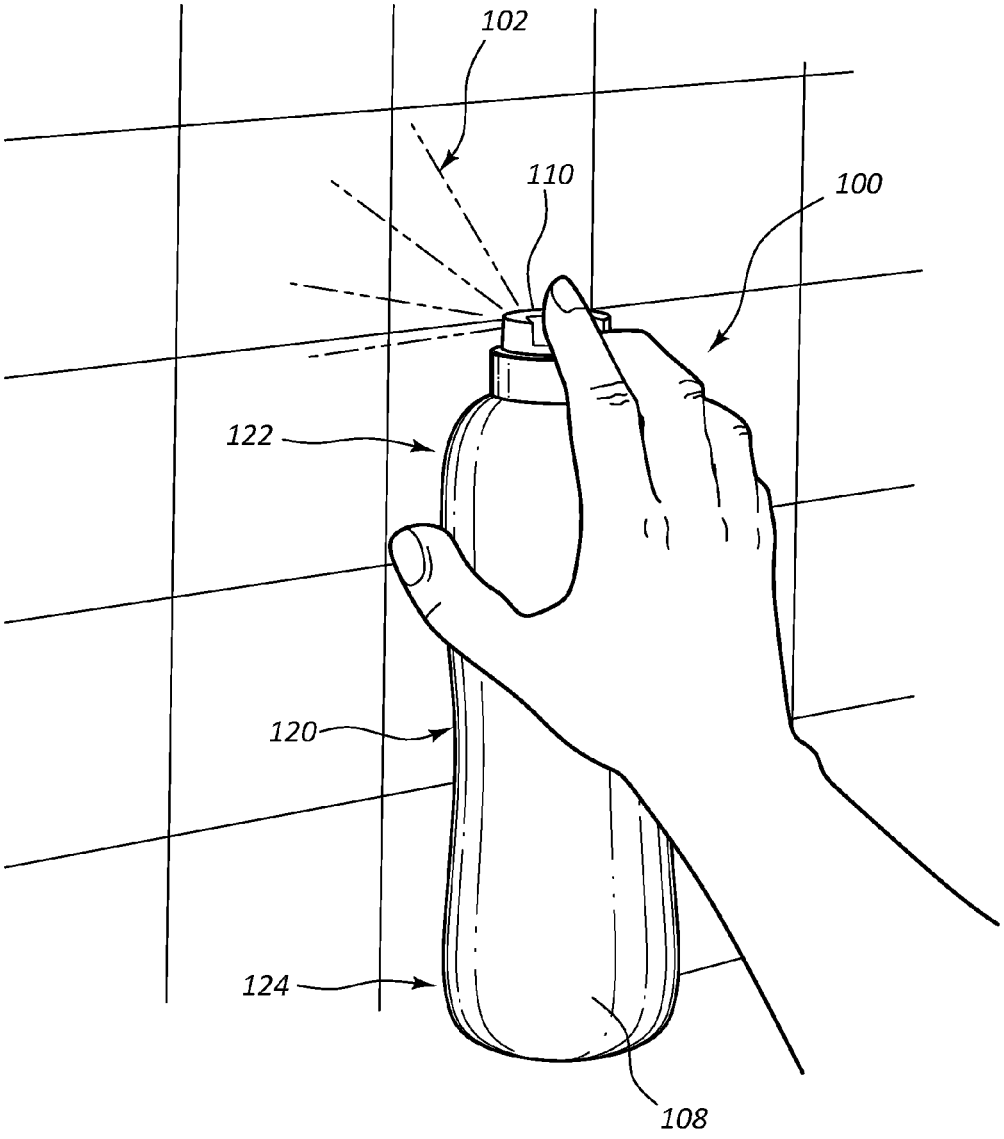
FIG. 3 shows a user actuating the actuator on the spray dispensing device, so that the fluid composition is dispensed from the spray dispensing device onto a shower wall.

The spray dispensing device configurations disclosed herein may also be used for dispensing fluid compositions that include other components that are corrosive or otherwise exhibit poor compatibility with metals or other materials typically employed in an aerosol dispenser. The spray dispensing devices may also be used for dispensing fluid compositions that do not include any such low-compatibility or corrosive components. FIG. 2 is a cut-away view into the dispensing device 100, better showing how the fluid composition 102 may be stored within an internal bladder 104 disposed within first chamber 106 defined by container 108. An actuator 110 may be provided, configured to selectively provide fluid communication with the interior of the bladder 104 within first chamber 106. Actuator 110 may be configured to dispense the fluid composition 102 from bladder 104 upon pressing or otherwise actuating actuator 110.

Actuator 110 may be any of a wide variety of mechanisms configured to dispense fluid composition 102 from bladder 104, as will be appreciated by those of skill in the art. Such actuator may be capable of selectively dispensing the fluid composition 102 from bladder 104 upon the consumer pressing a button or the like on actuator 110 to initiate dispensing. Such actuators will be apparent to those of skill in the art, and may be available from GUALA (Spinetta Marengo, Italy), AIROPACK (Waalwijk Netherlands), and other suppliers.

As perhaps best seen in FIG. 2, a second chamber 112 may also be provided, e.g., within container 108, separated from first chamber 106. Second chamber 112 acts as a pressure control device by which a pressurized composition 114 contained within second chamber 112 may be released as needed into first chamber 106 through outlet valve 116, which provides fluid communication between the second chamber 112 and the first chamber 106 when a pressure in first chamber 106 drops below a predetermined threshold value at which the outlet valve 116 is configured to permit one-way passage of pressurized composition 114. For example, the pressurized composition 114 within second chamber 112 may be at a first pressure that is higher than the pressure within first chamber 106. The outlet valve 116 may be configured to regulate flow of the pressurized composition 114 from second chamber 112 into first chamber 106, so as to maintain a given second pressure within first chamber 106 over the life of the spray dispensing device 100, until all fluid composition 102 has been dispensed. For example, by substantially constant, it is meant that the pressure within the first chamber may remain within 25%, within 20%, within 10%, or within 5% of a desired target value (e.g., about 40 psi).

By way of example, the outlet valve 116 may be configured as a one-way valve that automatically allows flow of the pressurized composition 114 from second chamber 112 when the pressure within the first chamber 106 drops below a specified threshold value. In this way, pressurized composition 114 from second chamber 112 is automatically delivered into first chamber 106 as needed to maintain first chamber 106 at the desired pressure, without any input by the consumer. Such pressure in the first chamber 106 may be selected by the manufacturer to provide a desired spray or aerosol pattern when dispensing fluid composition 102, as the pressure of the first chamber 106 drives dispensing of the fluid composition 102 in bladder 104 upon actuation of actuator 110.

One advantage of providing the configuration with a pressurized first chamber 106, and an internal bladder 104 connected to actuator 110, through which fluid composition 102 is dispensed is that fluid composition 102 may be dispensed even when the container 108 is in an inverted position, or any position in between inverted and a normal upright orientation as shown in the drawings. Furthermore, as will be appreciated, there is no requirement for a dip tube as is often found within many spray dispensing devices. For example, in at least some embodiments, no dip tube that typically extends from the actuator 110 into the reservoir of fluid composition 102, e.g., down to a bottom of the reservoir of fluid 102 is needed. This is because flexible bladder 104 progressively collapses about fluid composition 102 and actuator 110 as fluid composition 102 is dispensed, and the volume thereof in bladder 104 decreases. Thus, even without such a dip tube, the configuration may allow a very high fraction of fluid composition 102 to be dispensed over the life of the spray dispensing container (e.g., at least 90%, at least 95%, at least 97%, at least 98%, or at least 99%.

In addition, the configuration may allow a relatively high fraction of the volume defined within container 108 to actually be filled with fluid composition 102 which can be dispensed therefrom. For example, the dispensable volume of fluid composition may be at least 50%, at least 55%, at least 60%, at least 65%, at least 70%, at least 75%, at least 80%, at least 85%, or at least 90% of the volume defined within container 108. Such a configuration prevents a situation undesirable to consumers, where a large appearing container 108 only holds for dispensing a relatively small volume of fluid composition. Such can be frustrating to consumers.

By way of example, the pressure within first chamber 106 may be maintained at a pressure above atmospheric pressure (in order to provide the driving force needed to dispense the fluid composition from bladder 104, out of device 100). Pressure in first chamber 106 may be in a range from about 20 psi to about 70 psi, from about 25 psi to about 60 psi, or from about 30 psi to about 50 psi. In an embodiment, such pressures may be relative to atmospheric pressure (i.e., psig).

The pressure within second chamber 112 may be provided as manufactured at an initial value that is greater than the pressure maintained within first chamber 106. For example, in an embodiment, the initial pressure (i.e., before dispensing any fluid composition 102) within second chamber 112 may be from about 70 psi to about 150 psi, from about 80 psi to about 150 psi, from about 80 psi to about 120 psi, or from about 100 psi to 120 psi. As described above, the pressure values in the second chamber may be psig.

In embodiments where a liquid pressurized composition is provided within the second chamber, substantially higher pressures may be needed to maintain the liquid phase at temperatures typical for use and storage of the spray dispensing devices. Where a liquid pressurized component is employed, the pressurized component 114 may be in the liquid phase as stored in the second chamber, and may undergo a phase change to gaseous form after or as it passes through the outlet valve 116 into the first chamber (which is at a lower pressure). Such gaseous form of the pressurized component 114 will advantageously apply the desired pressure against the flexible collapsible bladder 104 storing fluid composition 102 so as to drive dispensing of fluid composition 102 upon actuation of actuator 110.

It will be apparent that the second chamber acts as a pressure control device, such that the actual pressure within the second chamber 112 may progressively decrease over the life of device 100, as pressurized composition within second chamber 112 is released through outlet valve 116 into first chamber 106. Thus, as the fluid composition 102 is dispensed, the pressure within second chamber 112 may progressively decrease as pressurized composition 114 is passed through outlet valve 116 into first chamber 106, e.g., to maintain first chamber 106 at a desired pressure sufficient to force fluid composition 102 within bladder 104 out of device 100 through actuator 110 in a desired spray pattern. The dispensing pattern may dispense the fluid composition 102 as an aerosol of very small droplets. Dispensing a liquid bleach composition as such an aerosol is particularly advantageous, as no such product has been commercially available to date.

By way of example, the pressurized composition 114 may include air, nitrogen, carbon dioxide, or combinations thereof. In an embodiment, the pressurized composition 114 may be provided in the second chamber in liquid phase. In other embodiments, it may be provided in gaseous phase. In one embodiment, no hydrocarbon propellants (e.g., isopentane, propane, isobutane, pentane, butane, fluorinated hydrocarbons, and the like) are needed, and no direct contact of the fluid composition 102 with the pressurized composition 114 need occur. In addition, it will be apparent from the above described structure that the pressurized composition 114 remains within the container 108, and is not required to be dispensed at all from the container 108. Such a configuration of course also prevents release of the pressurized composition 114 into the atmosphere at all, as it remains sealed within the container 108, even after the spray dispensing device 100 has reached the end of its useful life. If desired, such pressurized composition could be recovered and reused by collecting the spent spray dispensing devices, and recovering the pressurized component for reuse, or recycling, if desired. That said, because in this embodiment no hydrocarbon propellants having questionable environmental safety are employed, such will not typically be necessary, as the spent pressurized composition may be: air, nitrogen, carbon dioxide, nitrogen, inert components (e.g. argon) and any combinations thereof. The pressurized composition may be in solid, liquid or gaseous phases and any combinations thereof (e.g. liquid nitrogen, carbon dioxide gas, solid carbon dioxide, etc.). As described, the fluid composition 102 may advantageously be stored within bladder 104, which may be formed from a material that is specifically selected to be compatible with the particular fluid composition. For example, where the fluid composition includes an oxidizing agent, such as a halogen, a hypochlorite, hypochlorous acid, hydrogen peroxide, another peroxide, or combinations thereof, the bladder may be formed from an ethylene vinyl alcohol (EVA) material configured as a thin barrier film. Such EVA material may also be suitable for use with other fluid compositions stored in bladder 104. Other bladder materials may of course also be employed, so long as care is taken to ensure that the selected bladder material is compatible with the specific fluid composition 102 stored therein. In some embodiments, the interior surface of the bladder 104 could be coated with a barrier layer to allow an otherwise less compatible material to be used for the bladder 104. By "compatible", it is meant that the bladder material contacting the fluid composition 102 does not result in significant degradation, corrosion, dissolution, or other attack of the bladder material by the fluid composition 102 to be dispensed. Similarly, it is meant that the bladder material does not contaminate or otherwise alter the desired properties of the fluid composition 102 stored within the bladder 104. For example, a bladder material that inactivates a hypochlorite or other bleach composition would be undesirable where the fluid composition 102 being dispensed is a hypochlorite or other bleach.

Because the configuration of the spray dispensing device 100 ensures that the fluid composition 102 does not directly contact the interior of container 108, the container may be fabricated from materials that are attacked or otherwise incompatible with the fluid composition 102 (e.g., one or more metals). In an embodiment, the container may be made from a plastic material, such as polypropylene, polyethylene (including HDPE), polycarbonate, or combinations thereof. In another embodiment, the container may be made from one or more metal materials. Both metal and plastic materials could also be employed (e.g., for different parts of container 108). Similarly, the actuator may be made from suitable plastic materials, including, but not limited to those identified above. Such may be preferred as the fluid composition will come into contact with the at least some of the components of actuator 110, particularly where the fluid composition includes an oxidizing agent or corrosive or low compatibility agent. Where there are not compatibility concerns with the fluid composition and metal, at least some of the actuator components could be made of metal.

Figure 4:
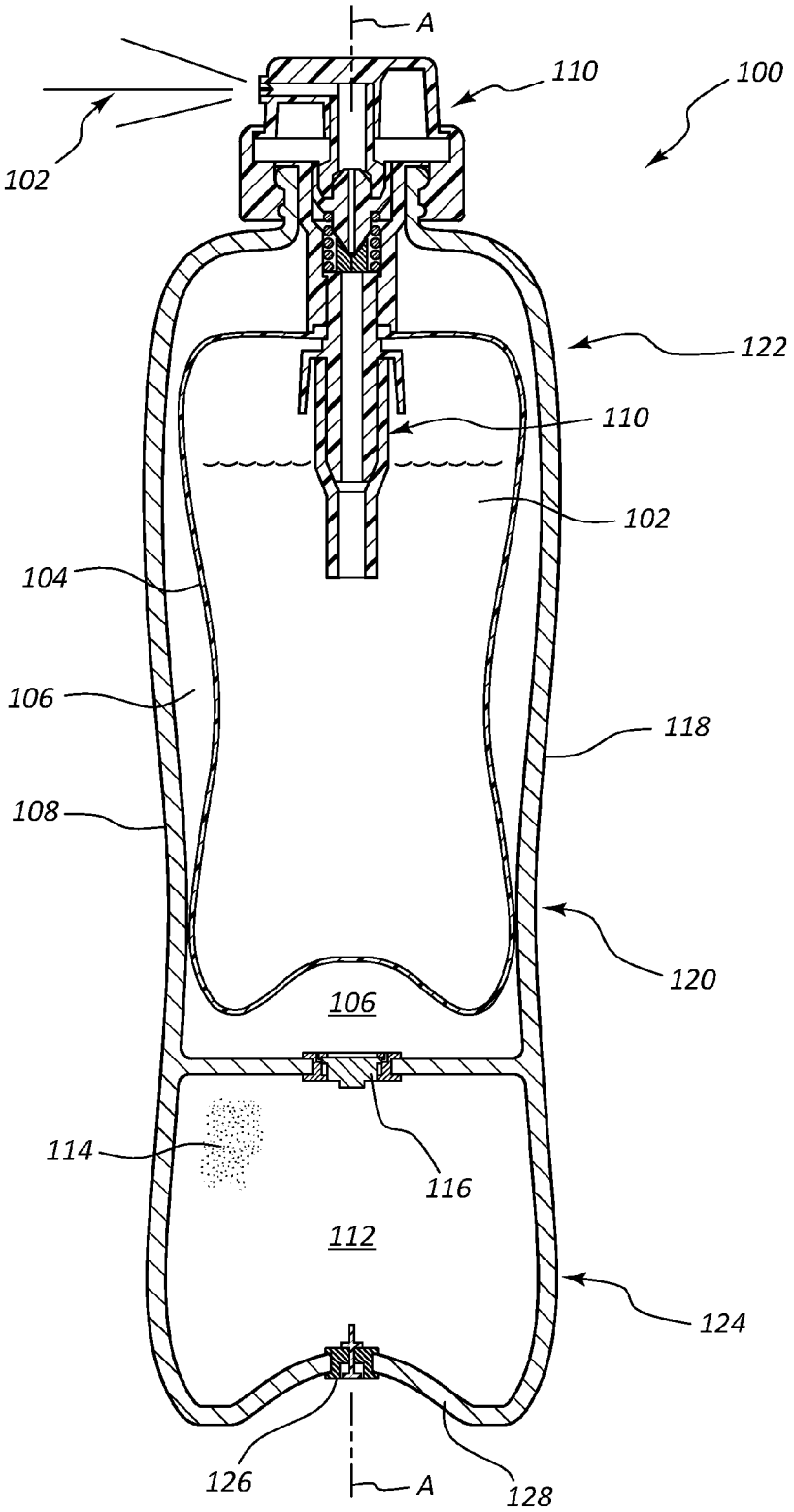
FIG. 4 is a cross-sectional view through the spray dispensing device of FIG. 3, with arrows showing flow of pressurized composition from the second chamber into the first chamber, and additional arrows showing application of forces that result in dispensing of the fluid composition from the bladder and actuator as an aerosol.

As is apparent from the structure described in conjunction with the Figures, no internal piston is needed within container 108. Because no internal piston is needed (dispensing instead relies on the bag-on-valve configuration of bladder 104, actuator 110, and pressurized first chamber 106), the container itself can have a contoured configuration not possible with containers that rely on an internal piston for dispensing. For example, as seen in FIGS. 1-4, the sidewalls 118 of container 108 may be non-linear, including a contoured, curved configuration within the central body portion (or elsewhere) in sidewall 118. FIGS. 1-4 show a configuration where the central body portion 120 may be narrower in width than the adjacent upper and/or lower portions 122, 124, respectively, of sidewall 118 of container 108. FIG. 4 shows how such contoured configurations allow the transverse cross-section of the first chamber 106 to vary along the vertical axis A of the chamber, due to the non-linear sidewall 118. Numerous other contoured shapes will be apparent to those of skill in the art that may be employed, because no internal piston is needed. For example, a contour may be provided which facilities improved ergonomic gripping of container 108 within the hand of a consumer (e.g., see FIG. 3) facilitating easier dispensing.

As seen in FIGS. 2 and 4, a plug or valve 126 may be provided in bottom wall 128, or elsewhere within second chamber 112, in order to allow charging of the pressurized composition 114 into second chamber 112 during manufacture. The pressurized composition 114 may thus be filled into second chamber 112 during manufacture through a valve (e.g., a one-way valve), or a hole which is subsequently stopped with a plug. Alternatively, a solid carbon dioxide composition could be added to the second chamber and then sealed on the bottom to create a pressurized composition without the need for filling the second chamber through a valve. Various other techniques for filling second chamber 112 will be apparent to those of skill in the art, and are within the scope of the present disclosure.

Figure 5:
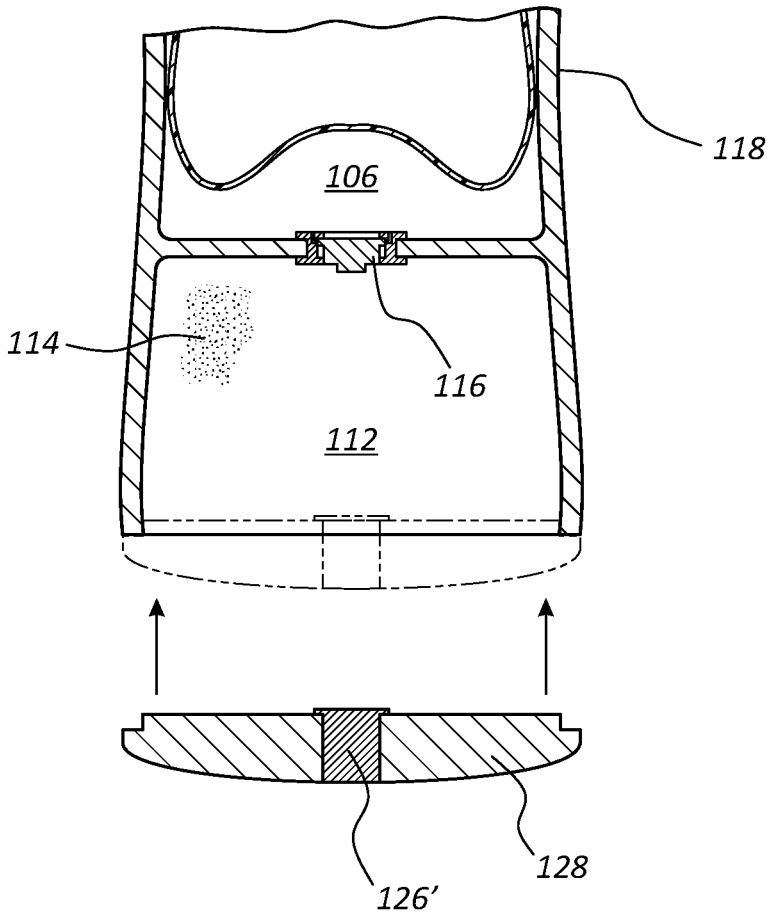
FIG. 5 is a cross-sectional view similar to that of FIG. 4, but showing an alternative configuration.

An alternative embodiment is shown in FIG. 5. For example, as shown in FIG. 5, bottom 128 may be sealed, e.g., with no inlet for pressurized composition 114. Rather, the composition (e.g., liquid nitrogen and/or liquid carbon dioxide) could be introduced into second chamber 112 during manufacture, followed by sealing of second chamber 112, as shown. For example, bottom wall 128 could be provided separate from sidewall 118, to be welded or otherwise secured thereto in a sealed arrangement. In another embodiment, a plug 126' (e.g., elastomeric, plastic, metal, or other material) could be inserted into an associated opening through bottom wall 128. Where the plug is plastic or metal, the plug 126' (e.g., similar to plug 126) could be welded or otherwise permanently sealed in place.

Such a configuration may be particularly suited for a pressurized composition 114 that is initially charged into second chamber 112 in liquid a liquid form (e.g., liquid nitrogen and/or liquid carbon dioxide). A solid form of such composition 114 may also be suitable (e.g., placement of dry ice (i.e., solid $CO_2$) or solid nitrogen into second chamber 112) for initial charging into second chamber 112. Once charged, the chamber 112 may be sealed (e.g., welding bottom wall 128 and/or plug 126' into place). Once charged, the composition 114 (e.g., which may initially be in a solid or liquid phase) may undergo a phase transition to the gaseous phase, providing the desired pressurized composition 114 for regulated release through outlet valve 116 into first chamber 106. Where composition 114 is initially in solid or liquid phase, care should of course be taken to ensure the charged amount is appropriate to provide the desired pressure within second chamber 112 once the initially solid or liquid composition 114 undergoes a phase change to be in gaseous phase.

Several suppliers would have the capability to manufacture the device as described herein (or components thereof), in light of the present disclosure. For example, AIROPACK, GUALA, and other suppliers would have the capability to produce the container, bladder, actuator, outlet valve, and other components described herein, if presented with the present disclosure. Additional details of exemplary bag-on-valve and pressure control devices, features of which may be incorporated herein are described in U.S. Pat. No. 8,292,121 and U.S. Publication Nos. 2001/0002598 and 2014/0183229, each of which is herein incorporated by reference in its entirety.

The fluid composition 102 to be dispensed may be any conceivable composition capable of being dispensed through the described structure. In some embodiments, the fluid composition may be a cleaning composition that may include an oxidizing agent. Such compositions may often include one or more surfactants. An organic or mineral acid (e.g., to aid in cleaning) may be included. One or more of a chelating agent, or one or more other adjuncts selected from the group consisting of fragrances, dyes, preservatives, humectants, solvents, polymers, pH adjusters, solubilizers, and combinations thereof may also be provided.

The composition may have a viscosity so that it may readily be dispensed as described herein. Liquid compositions may have a viscosity of less than 10,000 cps, or less than 1,000 cps. It may also be possible to dispense gel or foam compositions from the spray dispensing devices described herein, and such is within the scope of the disclosure. In one embodiment, the foam or gel may be dispensed without the need for a propellant or with a very small amount of propellant (e.g less than 20% propellant by weight, less than 15% propellant by weight, less than 10% propellant by weight, less than 5% propellant by weight, less than 2% propellant by weight, etc.)

In an embodiment, e.g., where the composition contains a hypochlorite component, the pH may be from about 8 to about 14, from about 9 to about 13, or from about 10 to about 13 (about 8, about 9, about 10, about 11, about 12, about 13, or about 14, or any range defined between any such values). A hypochlorite oxidizing agent may have increased stability at such elevated pH values. In other embodiments, and depending on the particular components included in the fluid composition, the composition may have a pH from about 1 to about 8, or from about 4 to about 8 (about 1, about 2, about 3, about 4, about 5, about 6, about 7, or about 8, or any range defined between any such values).

In one embodiment, the fluid composition may include one or more surfactants. Examples include, but are not limited to sulfates, sulfonates, betaines, alkyl polysaccharides, (e.g., alkyl polyglycosides, also known as alkyl polyglucosides), amine oxides, tweens, alcohol ethoxylates, and combinations thereof. One or more of the selected surfactants may provide foam building characteristics. The surfactant concentration may be any desired concentration. Examples may include up to 80%, up to 50%, up to 30%, up to 20%, or less than 10%, less than 5%, less than 4%, less than 3%, or less than 2% by weight, depending on the characteristics desired.

The surfactant(s) may include nonionic, anionic, cationic, ampholytic, amphoteric, zwitterionic surfactants, and mixtures thereof. A typical listing of anionic, ampholytic, and zwitterionic classes, and species of these surfactants, is given in U.S. Pat. No. 3,929,678 to Laughlin. A list of cationic surfactants is given in U.S. Pat. No. 4,259,217 to Murphy. Various alkyl polysaccharide surfactants are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. U.S. Pat. No. 4,565,647 to Llenado. Various nonionic surfactants can be found in U.S. Pat. No. 3,929,678 to Laughlin. Each of the above patents is incorporated by reference.

An organic acid (e.g., citric acid), or relatively weaker mineral acid (e.g., phosphoric acid) may be included for cleaning. Where included, such an acid may be included in an amount of less than 5%, less than 4%, less than 3%, less than 2% (e.g., from 1% to 2%, or from greater than 0.5% to about 1.5%).

Exemplary organic acid may include 2-hydroxycarboxylic acids or mixtures of two or more acids. Examples of such acids include, but are not limited to, tartaric acid, citric acid, malic acid, mandelic acid, oxalic acid, glycolic acid, lactic acid, and acetic acid.

pH adjusters (e.g., sodium hydroxide, or another hydroxide), if present, may typically be included in an amount of less than 3%, less than 2%, less than 1% (e.g., from about 0.5% or greater than 0.5% to 1%). For adjusting pH downward, any of the above described acids may also be suitable for use.

Solubilizers (e.g., to solubilize a fragrance or other oil), if present, may typically be included in an amount of less than 1%, less than 0.5%, less than 0.3% (e.g., from about 0.01% to 0.5%).

Dyes, fragrances, and/or preservatives, if present, may typically be included in an amount of less than 1%, or less than 0.5%. Oxidizing agents, or any other components mentioned herein may be present in amounts of less than 10%, less than 5%, less than 4%, less than 3%, less than 2%, less than 1%, less than 0.5%, or less than 0.25%. The fluid composition may be formulated as a ready-to-use composition (e.g., with less than 1%, less than 0.5%, or less than 0.25% oxidizing agent), although a concentrate formulation intended to be diluted (e.g., with water) may also be possible.

Specific compositions may be provided for kitchen use, for bathroom use, or for other specific or general uses. In some embodiments, the compositions may be effective at cleaning, and removing soils typically present in showers and bathtubs, such as, but not limited to soap scum, hard water stains, mildew, etc. The composition could also be used in other cleaning environments, e.g., such as kitchens, bathroom sinks, walls, etc. In a kitchen environment, the composition may be effective at cleaning and removing kitchen grease. The composition could be sprayed on bathroom countertops, kitchen countertops, sinks, tables, stovetops, dishes, windows, mirrors, or floors, to name just a few.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A spray dispensing device comprising:

(a) a container including (i) a first chamber wherein a constant pressure within the first chamber is maintained in the range from about 20 psi to 70 psi and (ii) a second chamber fluidly coupled to the first chamber;

(b) a bladder that is flexible and contained within the first chamber and housing a fluid composition comprising: one or more oxidizing agents selected from the group consisting of: halogens, hypochlorites, hypochlorous acid, hydrogen peroxide, other peroxides, and combinations thereof, wherein the flexible bladder comprises a material compatible with the one or more oxidizing agents;

(c) an actuator in fluid communication with the bladder is configured to dispense the fluid composition from the bladder upon actuation thereof;

(d) a pressurized composition contained within the second chamber at a pressure in a range from about 70 psi to about 150 psi; and (e) an outlet valve between the second chamber and the first chamber to allow the pressurized composition to flow from the second chamber to the first chamber, wherein the pressurized composition remains in the container;

wherein the pressurized composition does not contact the fluid composition but as the pressurized composition flows into the first chamber the constant pressure is applied to the bladder to drive dispensing of the fluid composition as an aerosol upon actuation of the actuator.

2. The spray dispensing device of claim 1, wherein the pressurized composition is selected from the group consisting of air, nitrogen, carbon dioxide, argon and combinations thereof.

3. The spray dispensing device of claim 1, wherein the container is made from a plastic material selected from the group consisting of polypropylene, polyethylene, polycarbonate, and combinations thereof.

4. The spray dispensing device of claim 1, wherein the container is made from one or more metal materials.

5. The spray dispensing device of claim 1, wherein the pH of the fluid composition is about 8 to 14.

6. The spray dispensing device of claim 1, wherein the fluid composition has a pH of about 9 to 13.

7. The spray dispensing device of claim 1, wherein the bladder comprises an ethylene vinyl alcohol barrier film.

8. The spray dispensing device of claim 1, wherein the dispensing device is free of any hydrocarbon propellants.

9. The spray dispensing device of claim 1, wherein the pressurized composition is selected from the group consisting of: nitrogen, carbon dioxide, argon and combinations thereof.

10. The spray dispensing device of claim 1, wherein the dispensing device is capable of continuously dispensing the fluid composition upon actuation.

11. The spray dispensing device of claim 10, wherein the first chamber maintains a substantially constant pressure of about 25 psi to 60 psi while the fluid composition is dispensed from the bladder over a life of the spray dispensing device.

12. A spray dispensing device comprising:

(a) a container including (i) a first chamber, wherein a constant pressure within the first chamber is maintained in the range from about 20 psi to 70 psi and (ii) a second chamber configured as a pressure control device;

(b) a bladder contained within the first chamber and housing a fluid composition;

(c) an actuator in fluid communication with the first chamber configured to dispense the fluid composition from the bladder upon actuation thereof;

(d) a pressurized composition contained within the second chamber, the pressurized composition being selected from the group consisting of: air, nitrogen, carbon dioxide, argon and combinations thereof; and (f) an automatic outlet valve which is configured for fluid communication between the second chamber and the first chamber;

wherein the pressurized composition flows from the second chamber to the first chamber through the automatic outlet valve to maintain the constant pressure at least until the bladder is substantially emptied of the fluid composition;

wherein the pressurized composition does not contact the fluid composition and the pressurized composition remains within the container and is not dispensed into the atmosphere;

wherein the bladder is formed of a first compatible material to house the fluid composition and the actuator is formed of a second compatible material to dispense the fluid composition.

13. The spray dispensing device of claim 12, wherein the container is made of a plastic material selected from the group consisting of polypropylene, polyethylene, polycarbonate and combinations thereof.

14. The spray dispensing device of claim 12, wherein the container is made of one or more metal materials.

15. The spray dispensing device of claim 12, wherein the fluid composition comprises one or more oxidizing agents.

16. The spray dispensing device of claim 15, wherein the one or more oxidizing agents are selected from the group consisting of halogens, hypochlorites, hypochlorous acid, hydrogen peroxide, other peroxides, and combinations thereof.

17. The spray dispensing device of claim 12, wherein the bladder comprises an ethylene vinyl alcohol barrier film.

18. The spray dispensing device of claim 12, wherein the container has a longitudinal axis and non-linear sidewalls along the longitudinal axis and a transverse cross-section of the first chamber that varies along at least a portion of the longitudinal axis.

19. The spray dispensing device of claim 12, wherein the pressurized composition comprises a liquid phase.

20. A spray dispensing device comprising:

(a) a container having non-parallel sidewalls, wherein a transverse cross-section of the container varies along a longitudinal axis of the container, wherein the container defines:

(i) a first chamber, and (ii) a second chamber to contain a pressurized composition selected from the group consisting of: nitrogen, carbon dioxide, liquid nitrogen, liquid carbon dioxide, and combinations thereof;

(b) a bladder that is flexible and contained within the first chamber, wherein the bladder is formed of a first compatible material to house a bleach composition;

(c) an actuator formed of a second compatible material and in fluid communication with the bladder configured to dispense the bleach composition as an aerosol from the bladder upon actuation of the actuator; and (d) an automatic outlet valve which communicates between the second chamber and the first chamber;

wherein the pressurized composition does not contact the bleach composition but as the pressurized composition flows into the first chamber a constant pressure is applied to the bladder to drive dispensing of the bleach composition upon actuation of the actuator;

wherein the constant pressure within the first chamber is configured to be maintained in the range of about 20 psi to about 70 psi by the pressurized composition flowing from the second chamber through the outlet valve into the first chamber;

wherein the second chamber is maintained at a pressure greater than at least about 20 psi until the bladder is substantially empty of the bleach composition due to the aerosol dispensing of the bleach composition.

21. The spray dispensing device of claim 20, wherein the bleach composition comprises a hypochlorite;

wherein the first compatible material of the bladder is configured to be compatible with the bleach composition.

22. The spray dispensing device of claim 21, wherein the bladder comprises an ethylene vinyl alcohol film.

23. The spray dispensing device of claim 22, wherein the container is unitary and defines first chamber and the second chamber.

24. The spray dispensing device of claim 22, wherein the sidewalls of the container are substantially non-cylindrical at the first chamber.

* * * * *